US005499424A

United States Patent [19]

Lau

[11] Patent Number: 5,499,424

[45] Date of Patent: Mar. 19, 1996

[54] CLEANING DEVICE FOR HARD AND FLAT SURFACES

[75] Inventor: Alfred T. Lau, Hong Kong, Hong Kong

[73] Assignee: Senson Investments Limited, Hong Kong, Hong Kong

[21] Appl. No.: 319,784

[22] Filed: Oct. 7, 1994

[51] Int. Cl.[6] ..... A47L 1/095

[52] U.S. Cl. ..... 15/322; 15/367; 15/401; 15/419

[58] Field of Search ..... 15/321, 322, 367, 15/401, 418, 419

[56] References Cited

U.S. PATENT DOCUMENTS

| | | | |
|---|---|---|---|
| 2,516,246 | 7/1950 | Norris | 15/367 |
| 3,184,780 | 5/1965 | Hageman | 15/322 |
| 4,083,077 | 4/1978 | Knight | 15/321 |
| 4,557,013 | 12/1985 | Belmont | 15/419 |
| 4,879,784 | 11/1989 | Shero | 15/322 |

FOREIGN PATENT DOCUMENTS

| | | | |
|---|---|---|---|
| 2572920 | 5/1986 | France | 15/321 |
| 4125866 | 2/1993 | Germany | 15/322 |

*Primary Examiner*—David Scherbel
*Assistant Examiner*—Terrence R. Till
*Attorney, Agent, or Firm*—Burns, Doane, Swecker & Mathis

[57] ABSTRACT

A cleaning head for use with suction means particularly suitable for cleaning hard, flat and smooth surfaces, such as glass or marble walls. The cleaning head is equipped with attachments for cleansing liquid application, scrubbing, wiping and waste liquid removal in one piece and is normally closed so that no waste liquid inside the head will leak out during quiescent operating condition.

15 Claims, 3 Drawing Sheets

CLEANING DEVICE FOR HARD AND FLAT SURFACES

FIELD OF THE INVENTION

The invention relates to a cleaning device, more particularly, to a cleaning head which is used to apply cleansing liquid onto a surface, to scrub the surface thus treated and to wipe and to remove residual waste cleansing liquid from it. More specifically, this invention relates to a cleaning head particularly suitable for cleaning surfaces which are flat, impervious and smooth.

BACKGROUND OF INVENTION

Glass, brass, granite, tiles and other materials which can be made to have a hard, smooth and impervious surface are widely used as mirrors, windows, walls or displays in both domestic and high-rise commercial buildings. The exterior appearance of premises or buildings is always regarded as a reflection of the image, personality or characteristics of their owners or occupants, regular cleaning of external surfaces are therefore required to maintain a clean, spotless and dust-free look. These surfaces are always shiny, either highly reflective or transparent, good cleaning would therefore require application of a suitable cleansing agent, scrubbing with a soft material such as foam, sponge, wool or cloth, and drying immediately after scrubbing to avoid residual stains.

Many of these surfaces are large and tall and are often found in business districts or shopping arcades where there is a high pedestrian turn-around rate. Conventional cleaning methods using ladder with bucket, mop and wiper become dangerous and inefficient. Furthermore, residual used liquid not completely removed will be collected at the edges and forming mouldy or rusty layer of residue deposit. There is therefore a particular need for an integral unit which combines cleanser application, scrubbing and drying for this kind of surface in one single trait.

DE 4125866 discloses a cleaning device which comprises a rubber blade for wiping and a vacuum suction nozzle for removing residual fluid or particles. This device, however, requires very strong suction power to retain used liquid inside the suction nozzle when the device is lowered and is not satisfactory. Practical experience shows that, unless the nozzle is always maintained in an upward position, dirty residual matter always drips and leaks out of the nozzle, causing inconvenience add nuisance to both the user and passers-by. For domestic users, dripping of dirty liquid on carpeted floors or upholstery can also be irritating.

SUMMARY OF THE INVENTION

It is therefore an object of the present invention to provide a cleaning device which can combine cleaning, scrubbing and efficient residual matter removal in a single integral unit while overcoming the above-mentioned problems.

According to the present invention, there is therefore provided a cleaning device for use with a suction means comprising a head and neck portion, wherein a) said neck portion is in abutment with said head portion and connectible with a suction means; and b) said head portion comprises a base housing and a closure means, said base housing having an inlet edge, said inlet edge being normally in contiguous contact with said closure means, and said closure means being movable relative to said base housing and being normally urged against said inlet edge of said base housing, and being movable away from said inlet edge when pressed against surfaces to be cleaned.

Preferably the closure means comprises i) a rigid, non-absorbent closure plate attached to said base housing along one edge and another edge being movable relative to the housing at the inlet edge, and ii) a wiper blade which is flexible, non-absorbent and releasably attachable to the closure plate.

Preferably head portion of the device further comprises i) a top cover which is rigid and releasably attachable to the closure means, and ii) a wiper blade which is flexible and non-absorbent and sandwiched between the closure means and top cover.

Preferably the cleaning device further comprises scrubbing means having soft, absorbent material secured onto a rigid, non-absorbent attachment means which is releasably attachable from the device.

BRIEF DESCRIPTION OF THE DRAWINGS

A preferred embodiment of the present invention will now be explained by way of example and with reference to the accompanying drawings, in which.

DETAILED DESCRIPTION OF THE PREFERRED EMBODIMENT

Figure 1:
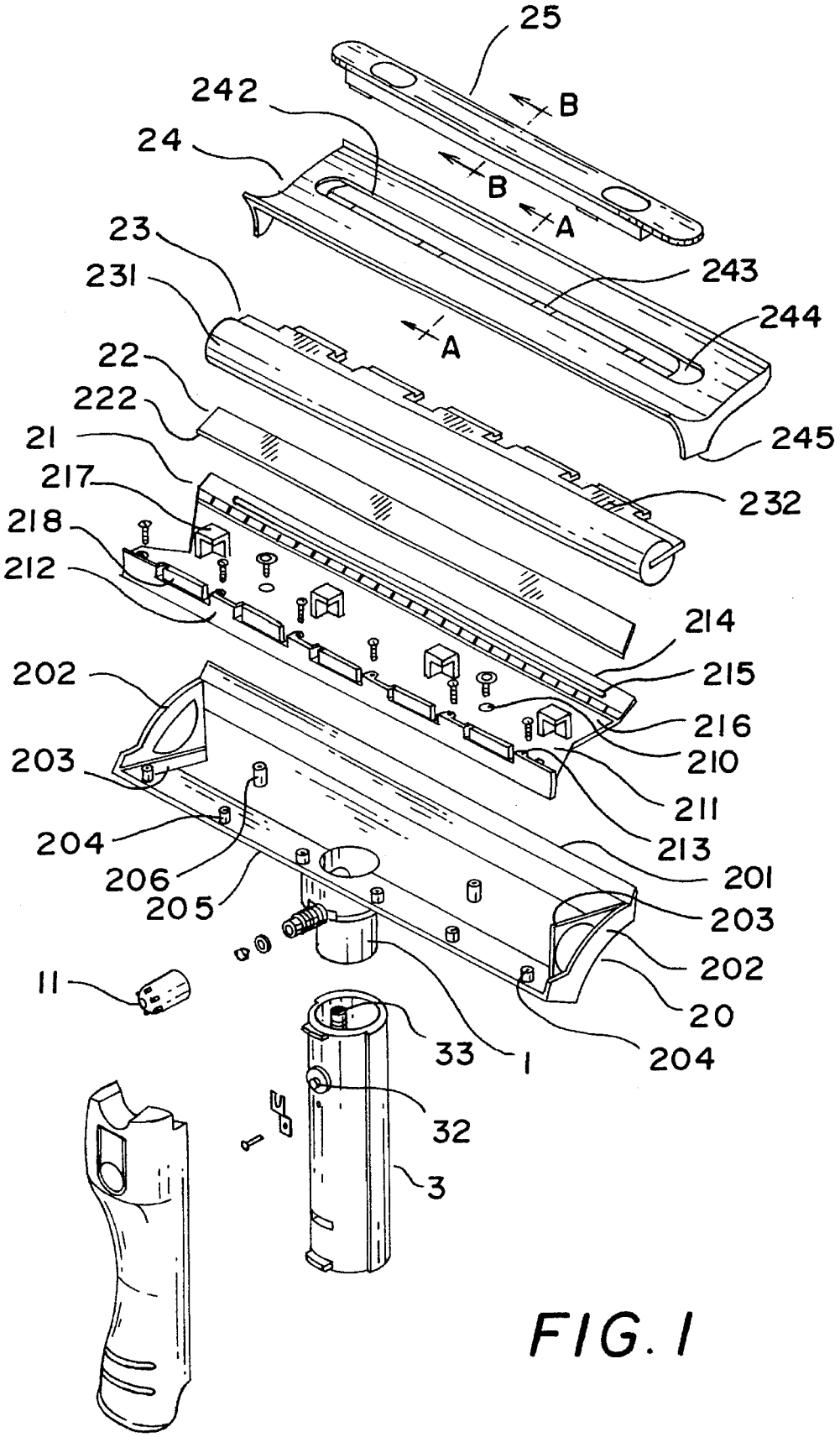
FIG. 1 is an exploded view of a cleaning device embodying the present invention.
Figure 2:
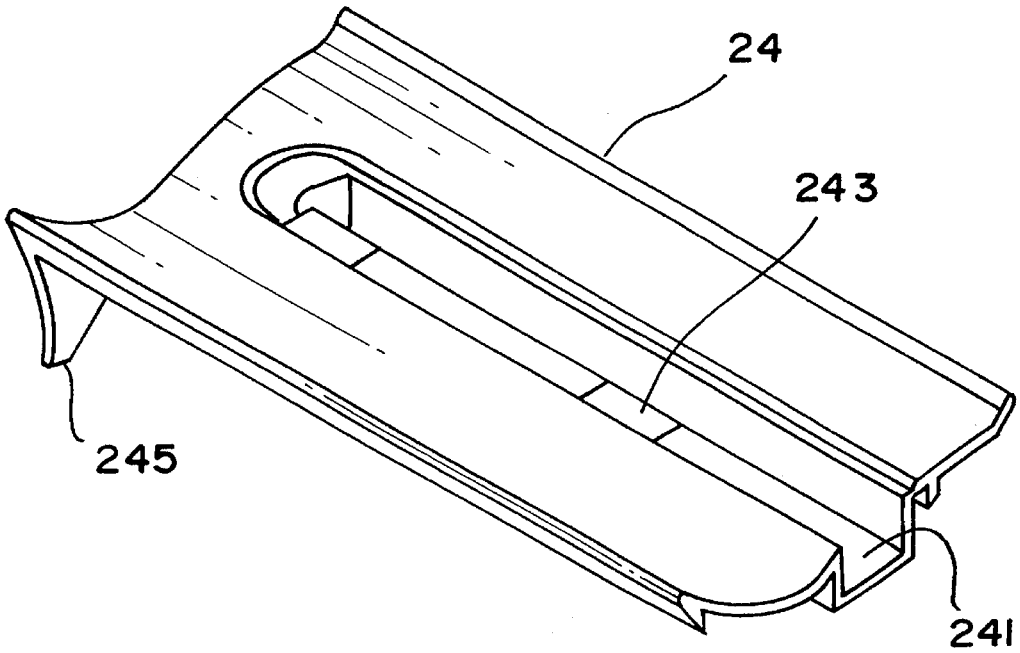
FIG. 2 is a perspective view of a top cover for the device of FIG. 1 in the direction A—A.
Figure 3:
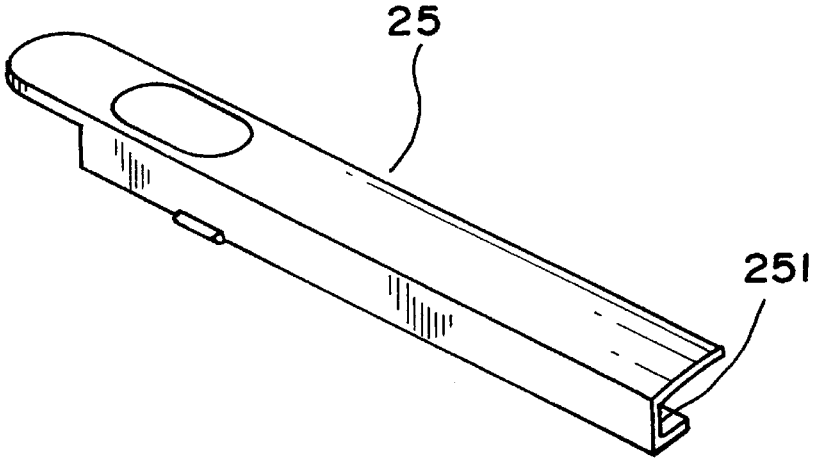
FIG. 3 is a perspective view of a locking member for the device of FIG. 1 in the direction B—B.
Figure 4:
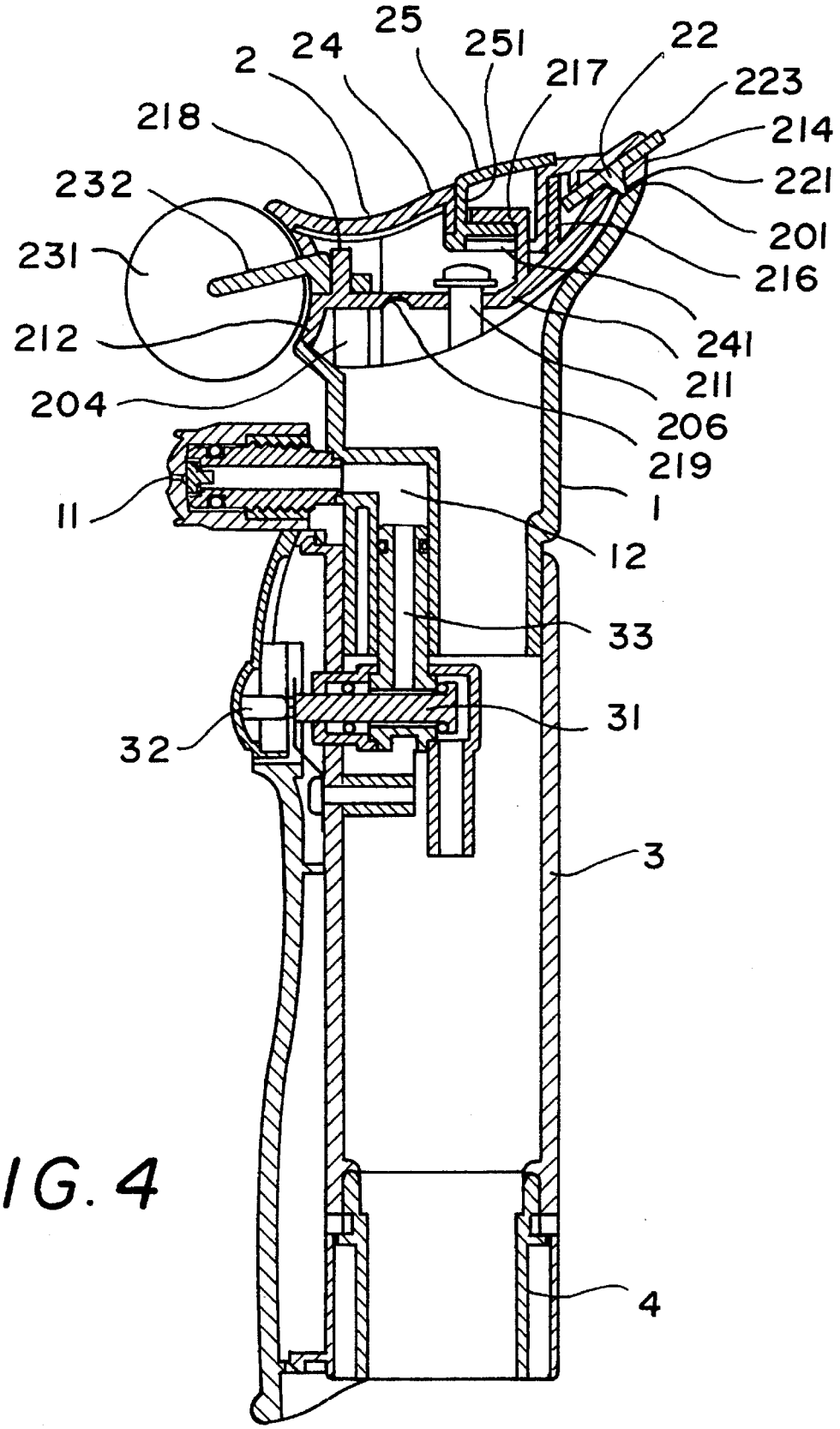
FIG. 4 is the cross-sectional view of the assembled cleaning device of FIG. 1.

Referring to FIGS. 1 to 4, there is shown a cleaning device embodying the present invention comprising a neck 1 and a head 2 portion. The neck 1 comprises a generally tubular section for connection via a handle 3 to a vacuum suction means 4 which is also provided with a waste matter storage (not shown here). A nozzle 11 is mounted on the outside of the neck portion 1 by securing onto coupling means on a duct 12 which is formed on the inside of the neck portion 1. Pressurised cleansing solution supplied from a reservoir (not shown) to the duct is released from the nozzle 11 by a mechanical valve 31 controllable by a mechanical switch 32 on a detachable handle 3. The handle 3 also contains a length of duct 33 and is detachable to allow different possible extensions to be connected between the neck portion 1 and its top part to allow a large cleaning area coverage.

An elongated head 2, transverse to the axis of the neck 1, is formed at the top-end of the neck 1. The head 2 comprises a base housing 20, jaw 21, wiper blade 22, scrubbing means 23, top cover 24, and locking plate 25.

The elongated base housing 20 is made preferably of a hard and durable material such as plastics, it has a partly cylindrical shape with front inlet edge 201 curving upwards. Two sealing walls 202 extending vertically from the base housing 20 are formed at the two ends. Portions of the base housing 20 near the two ends are formed as convex surfaces, intersection of the convex surfaces with the concave base housing forms generally parabolic loci. Two vertical V-shaped sealing walls 203 are formed substantially along the parabolic intersection lines to provide further sealing.

The base housing 20 abuts the neck 1 near the middle, so that the device resembles the external appearance of a suction head for an ordinary vacuum cleaner. A plurality of hollow lugs 204, capable of screw engaging, are formed along a straight line near the rear edge 205. Another row of hollow lugs 206 are formed near the middle of the base housing 20 as part of the means for limiting maximum displacement of the jaw 21 relative to the base housing 20.

The jaw 21 is made preferably of a hard, resilient and non-permeable material, such as polypropylene or other hard plastic materials, and comprises a valve plate 211 which has a generally V-shaped cross-section and is receivable inside the space between the top cover 24 and the base housing 20. Near the rear edge 212, there are provided a plurality of through-holes 213, corresponding to the number of aforementioned hollow lugs 204 on the base housing 20, so that the jaw 21 can be affixed onto the base housing 20 with screws or other fasteners. Another row of through-holes 210 are formed at positions corresponding to the aforementioned lugs 206 so that displacement limiting means, such as large-headed screws, can be fastened onto the lugs through the holes 210 to limit maximum jaw 21 displacements. Formed near the front edge 214 is a slot 215 which is designed to accommodate the vertical limb 221 of a T-shaped wiper blade 22 inside and prevent dislocations thereof.

At a distance about half the blade width behind the slot 215, there is provided a vertical guard wall 216 which extends vertically from the upper surface of the jaw 21 and is designed to be just in contact with rear edge 222 of the wiper blade 22 so that horizontal displacement thereof beyond the wall 216 is prohibited. Behind the guard wall 216 and near the middle of the jaw 21 there are formed along the length a plurality of inverted L-shaped retaining means 217 for coupling with corresponding engaging means 25 1 formed on a slidable locking plate 25. Near the rear edge 212 of the jaw 21 there is provided a plurality of wall-liked protrusions 218 to allow scrubbing means 23 with attachment means to be releasably attached thereto. Thickness of the jaw 21 just before the rear edge 212 is reduced, forming a notch 219, and therefore a weakness, along the width. This notch 219 becomes a pivotal axis about which the front pan of the jaw 21 will be movable when its front part is forced to depart from the front inlet edge 201 of the base housing.

The wiper blade 22 has about the same length as the base housing 20, has a T-shaped cross section to prevent dislocation and is made of a generally flexible, resilient and non-absorbent material, such as silicon rubber, which would not cause scratching on delicate surfaces and is generally considered optimal for cleaning such surfaces. When the wiper blade 22 is properly placed inside the slot 2 15 and fixed in position, its vertical limb 221 extends beyond the slot 215 and is in contiguous contact with the front part of the base housing 20, forming a gate 221 which prevents transportation of matter in and out of the device unless gate 221 is opened.

The scrubbing means 23 is formed preferably by securing a soft and absorbent material 231 suitable for scrubbing, such as sponge, wool, cloth or other synthetic materials, onto a rigid frame 232 which is releasably attachable to the protruding walls 218 formed on the jaw 21. Preferably the frame 232 is also dimensioned with a shape complementary to the rear edge of the jaw 21 to improve sealing against liquid leakage.

A top cover 24, made preferably of the same material as the base housing 20, is designed to sandwich the wiper blade 22 tightly between it and the jaw 21. Such a cover also completes the head housing and therefore also serves to improve the air- and water-tightness. The top cover 24 is formed integrally with a rectangular trough 241 on the bottom of which there are provided a plurality of openings 243 just enough for passage of the aforementioned inverted L-shaped retaining means 217. Furthermore, area of the top cover 24 around the ends and front edge 242 of the trough opening is formed into a shallow indentation 244 to allow a locking plate 25 to sit in and slide on. To complete the construction, there is provided an inverted L-shaped locking plate 25 with a plurality of L-shaped engaging means 251 formed on the lower-side thereof. After the wiper blade 22 and the top cover 24 are put in place, the locking plate 25 is placed inside the aforementioned indentation 244, slightly depressed and slided to the left edge of the indentation 244 at which point the inverted L-shaped retaining means 217 interlock with the L-shaped engaging means 251, thereby securing the top cover 24 and wiper blade 22 together with the base housing 20. When the wiper blade 22 is pressed against a hard surface, front part 214 of the jaw 21 is forced to depart from the base housing 20, bringing with it a pivotal movement of the top cover 24 about the contact edge 245 with base from the inlet edge 201 of housing 20.

In operation, the cleaning device is connected to a vacuum suction means 4, such as a vacuum cleaner or vacuum pump, via the neck 1 and handle 3. Cleansing liquid supply duct 33 is connected to a reservoir from which cleansing liquid can be pressurised and continuously supplied to the surfaces through the nozzle 11. Surfaces thus wetted with cleansing liquid can be scrubbed thoroughly with the attached scrubbing means 23. The residual waste liquid, usually dirty and blended with pollutants, can be wiped by pressing and sliding the wiper blade 22 on the surface, the reactive force exerted on the jaw 21, through the wiper blade 22, by the surface causes the gate 221 to open and the proximity of the slit opening thus formed at the inlet edge 201 is therefore under the influence of suction means 4, residual fluid will therefore be sucked inside the device towards the suction means, thereby producing perfect cleaning with no leakage of dirty residual matter.

If the head 2 is not pressed against a hard surface, as in normal stand-by conditions, bias on the jaw 21 towards the base housing 20 always urges the gate 221 to close, thereby preventing waste matter leakage.

After prolonged repeated use, the wiper blade 22 may be worn out or hardened. Replacement can easily be done by firstly unlocking the locking plate, thereby releasing the top cover 24, and then inserting a new replacement wiper blade. The scrubbing means 23 can also be replaced in a similar manner.

While the present invention has been described with reference to a preferred embodiment, it will be appreciated that many other variations, modifications and applications of the invention may be made.

I claim:

1. A cleaning device for use with a suction means comprising a head portion and a neck portion, wherein:

a) said neck portion is in abutment with said head portion and connectible with a suction means; and b) said head portion comprises a base housing and a closure means for closing an inlet to the head portion, i) said base housing having an inlet edge defining said inlet, said inlet edge being normally in contiguous contact with said closure means, and ii) said closure means comprising a rigid, non-absorbent closure plate pivotally attached to said base housing along one edge so that another edge is movable relative to said housing at said inlet edge, and a wiper blade, said wiper blade being flexible, non-absorbent and releasably attachable to said closure plate, said closure means being normally urged against said inlet edge of said base housing, and being movable away from said inlet edge when pressed against surfaces to be cleaned.

2. A cleaning device according to claim 1, wherein said head portion further comprises:

a top cover, said top cover being rigid and releasably attachable to said closure means, and wherein said wiper blade is sandwiched between said closure means and said top cover.

3. A cleaning device according to claim 1, wherein said cleaning device further comprises scrubbing means having soft, absorbent material secured onto a rigid, non-absorbent attachment means, said attachment means being releasably attachable from said device.

4. A cleaning device according to claim 1, wherein said cleaning device further comprises means for dispensing cleansing agent onto the surfaces to be cleaned.

5. A cleaning device according to claim 1, wherein said wiper is also in contiguous contact with said inlet edge of said base housing.

6. A cleaning device according to claim 1, wherein said closure plate further comprises means for retaining said wiper blade.

7. A cleaning device according to claim 1, wherein said wiper blade is made of silicon rubber.

8. A cleaning device according to claim 1, wherein said closure plate is made of polypropylene.

9. A cleaning device for use with suction means, comprising:

a head portion and a neck portion said neck portion having an axis, wherein said neck portion is formed integrally with said head portion and is connectible to suction means and wherein said head portion includes an inlet edge defining an inlet extending substantially at a right angle to the axis of said neck portion;

a closure plate pivotally mounted to said head portion for closing said inlet; and a flexible wiper blade releasably mounted to said closure plate in said head portion and extending substantially parallel to said inlet, said wiper blade being movable between a normal position in which a portion of said wiper blade abuts said inlet edge to close said inlet, and a position in which said wiper blade is separated from said head portion to open said inlet.

10. A cleaning device as claimed in claim 9, wherein said head portion comprises a base member and wherein one edge of said closure plate is attached to said base member and said wiper blade is mounted to an opposite edge of said closure plate adjacent said inlet.

11. A cleaning device as claimed in claim 10, wherein said closure plate is formed to have a portion of reduced thickness, said reduced thickness portion forming a pivot point.

12. A cleaning device as claimed in claim 9, wherein said head portion further comprises a top cover, said wiper blade being sandwiched between said top cover and said closure plate.

13. A cleaning device as claimed in claim 9, wherein said wiper blade has a generally T-shaped cross-section and is disposed so that a vertical limb of said T-shaped cross-section serves to close said inlet.

14. A cleaning device as claimed in claim 9, wherein said cleaning device further comprises scrubbing means having soft, absorbent material secured onto a rigid, non-absorbent attachment means, said attachment means being releasably attached to said device.

15. A cleaning device as claimed in claim 9, further comprising means for dispensing a cleansing agent onto surfaces to be cleaned.

* * * * *